US005404703A

United States Patent [19]

Frentzel-Beyme et al.

[11] Patent Number: 5,404,703

[45] Date of Patent: Apr. 11, 1995

[54] TEXTILE YARN PROCESSING MACHINE HAVING DEVICES FOR REDUCING FRICTIONAL CONTACT BETWEEN A ROTATING YARN BALLOON AND A BALLOON LIMITER

[75] Inventors: Johannes Frentzel-Beyme, Mönchengladbach; Rainer Lorenz, Nettetal-Breyell; Helmut Heiser, Mönchengladbach, all of Germany

[73] Assignee: Palitex Project Company GmbH, Krefeld, Germany

[21] Appl. No.: 253,098

[22] Filed: Jun. 2, 1994

Related U.S. Application Data

[62] Division of Ser. N0. 970,002, Nov. 2, 1992, Pat. No. 5,329,755.

[30] Foreign Application Priority Data

May 26, 1992 [DE] Germany ..... 42 17 360.4
Jul. 15, 1992 [DE] Germany ..... 42 09 495.3

[51] Int. Cl.[6] ..... D01H 1/42
[52] U.S. Cl. ..... 57/58.36; 57/354
[58] Field of Search ..... 57/58.3, 58.32, 58.34, 57/58.36, 58.38, 58.83, 58.84, 58.86, 352, 354, 355, 356, 357; 242/128

[56] References Cited

U.S. PATENT DOCUMENTS

| | | | |
|---|---|---|---|
| 2,745,239 | 5/1956 | Kingsbury | 57/354 |
| 2,794,491 | 8/1961 | Weber | 242/128 |
| 3,011,736 | 12/1961 | Fürst et al. | 242/128 |
| 3,077,726 | 2/1963 | Lenk | 57/58.83 |
| 3,094,835 | 6/1963 | Nimtz et al. | 57/58.83 X |
| 3,718,296 | 2/1973 | Mahoney et al. | 242/128 |
| 5,044,572 | 9/1991 | Grecksch et al. | 242/128 |

FOREIGN PATENT DOCUMENTS

| | | | |
|---|---|---|---|
| 333885 | 9/1989 | European Pat. Off. | 57/58.36 |
| 1211975 | 9/1966 | Germany | 57/352 |
| 203338 | 10/1983 | Germany . | |
| 936509 | 9/1963 | United Kingdom . | |

*Primary Examiner*—Joseph J. Hail, III
*Attorney, Agent, or Firm*—Bell, Seltzer, Park & Gibson

[57] ABSTRACT

A textile yarn processing machine has a plurality of spindle assemblies for processing of yarn. Each spindle assembly includes mechanisms for forming a balloon of yarn which rotates around a spindle assembly central axis as the yarn travels through the spindle assembly during processing and a balloon limiter device surrounding the rotating balloon of yarn and having a generally cylindrical inside surface for frictional contact with the rotating balloon of yarn to restrict the size thereof. Devices are provided which reduce frictional contact between the rotating balloon of yarn and the inside surface of the balloon limiter so as to avoid the necessity of the use of lubricators on the yarn. These devices (1) form an undulating pattern of travel for the yarn through the rotating balloon of yarn so as to create times of contact and times of no contact of predetermined segments of the yarn with the inside surface of the balloon limiter and (2) create relationships wherein the sum of the times of contact of a segment of yarn advancing through the yarn balloon with the inside surface of the balloon limiter is to the total time of advance of this yarn segment through the rotating balloon as is 1:5 to 1:200 and wherein each time of contact of the traveling yarn element with the inside surface of the balloon limiter is to each time of no contact as is 1:2 to 1:20.

1 Claim, 9 Drawing Sheets

46.1
F1
46
F2
1.4
3
F1.2
F1.1
SP1
1

TEXTILE YARN PROCESSING MACHINE HAVING DEVICES FOR REDUCING FRICTIONAL CONTACT BETWEEN A ROTATING YARN BALLOON AND A BALLOON LIMITER

This application is a division of application Ser. No. 07/970,002, filed Nov. 2, 1992, now U.S. Pat. No. 5,329,755.

FIELD OF THE INVENTION

This invention relates to a textile yarn processing machine having a plurality of spindle assemblies for processing of yarn and devices for reducing frictional contact between the rotating balloon of yarn and the inside surface of a balloon limiter so as to avoid the necessity of using lubricators on the yarn.

BACKGROUND OF THE INVENTION

Heretofore, yarns processed in yarn processing machines, including two-for-one twisters, cablers and the like, have been treated with lubricators for reducing wear resulting from frictional contact of the yarn and for other reasons well known to those with ordinary skill in the art. For environmental reasons, it is desirable to eliminate, if possible, the use of such lubrication on yarns. However, yarns processed in textile yarn processing machines having spindle assemblies which form a balloon of yarn rotating around the spindle assembly central axis as the yarn travels through such spindle assemblies during processing and a balloon limiter device surrounding the rotating balloon of yarn, create problems with excessive frictional engagement between the rotating balloon of yarn and the inside surface of the balloon limiter. Such frictional engagement will create extreme heat in the yarn and undesired wear without the presence of the usual yarn lubricators.

OBJECTS AND SUMMARY OF THE INVENTION

Therefore, it is the object of this invention to provide a textile yarn processing machine of the type discussed above which includes devices which reduce the frictional contact between the rotating balloon of yarn and the inside surface of the balloon limiter such that the necessity for the use of yarn lubricators may be eliminated.

It has been found by this invention that this object may be accomplished by providing the following. A textile yarn processing machine has a plurality of spindle assemblies for processing of yarn. Each spindle assembly includes a central axis, means for forming a balloon of yarn which rotates around the spindle assembly central axis as the yarn travels through the spindle assembly during processing, and a balloon limiter device surrounding the rotating balloon of yarn and having a generally cylindrical inside surface for frictional contact with the rotating balloon of yarn to restrict the size of the rotating balloon of yarn. This yarn processing machine includes the improvement of means for (1) forming an undulating pattern of travel for the yarn through the rotating balloon of yarn so as to create times of contact and times of no contact of predetermined segments of the yarn with the inside surface of the balloon limiter as the yarn segment travels through the balloon limiter and (2) creating relationships wherein the sum of the times of contact of a segment of yarn advancing through the yarn balloon with the inside surface of the balloon limiter is to the total of time of advance of this yarn segment through the rotating yarn balloon as is 1:5 to 1:200 and wherein each time of contact of the traveling yarn element with the inside surface of the balloon limiter is to each time of no contact as is 1:2 to 1:20. With this textile yarn processing machine construction, frictional contact between the rotating balloon of yarn and the inside surface of the balloon limiter is reduced and periods of no contact for segments of yarn advancing through the yarn balloon allows the yarn to cool during such periods of no contact, all of which allows elimination of the usual yarn lubricators, as desired by this invention.

The means for forming the undulating path of travel for the yarn and creating the above described relationships may comprise a ring having an inside and an outside surface and positioned for running engagement by the yarn around one of these surfaces as the yarn travels through the rotating balloon of yarn. The surface being engaged by the yarn has an undulating configuration which deviates from circularity in radial direction and in a predetermined manner corresponding to the desired predetermined undulating pattern of travel for the yarn. The undulating configuration surface of the ring being engaged by the yarn preferably comprises cams having a sinusoidal contour and defining alternating cam tips and cam valleys. The amplitude of the cams is preferably from about 2 to 10 mm. The number of cams on the undulating configuration surface is preferably about 7 to 19.

A preferred positioning for the ring is along the central axis of the spindle assembly and generally above the balloon limiter device at or in an upper end portion of the rotating balloon of yarn. It is preferred that the ring is positioned at approximately 62% to 88% of the height of the rotating balloon of yarn.

The surface of the ring engaged by the yarn may be the inside surface and a radial distance between opposing inwardly-directed ones of the cam tips may be about 40 to 50 mm and a distance between opposing outwardly-directed cam valleys may be about 50 to 160 mm. The ring may further include means mounting the ring for rotation and drive means for rotating the ring at a rotational speed which deviates from a rotational speed of the balloon of yarn.

Alternatively, the surface of the ring being engaged by the yarn may be the outside surface. In another variation, the ring may be mounted on the inside surface of the balloon limiter and the surface of the ring engaged by the yarn would be the inside surface. In still another variation, the undulating configuration surface of the ring being engaged by the yarn may be shaped as a regular polygon and the entire ring may be polygon shaped.

In a further embodiment, the means for forming the undulating pattern of travel for the yarn and for creating the above discussed relationships is positioned along the central axis of the spindle assembly and generally above the balloon limiter device adjacent an upper end of the rotating balloon of yarn for running engagement therewith by the yarn during travel of the yarn through the rotating balloon of yarn and comprises two bars facing each other and extending parallel to each other and obliquely to the spindle assembly central axis and having inside surfaces contacted by the yarn during travel of the yarn through the rotating balloon of yarn.

In yet another embodiment, the means for forming the undulating path of travel for the yarn and for creating the above discussed relationships comprises coil means in the form of a helix on the inside surface of the balloon limiter device and which has a predetermined coil thickness of the helix smaller relative to an axial spacing of adjacent coils to accomplish the above discussed relationships. The coil means may be in the form of a double or single helix. The device may also include means for mounting the coil means and for changing a coil pitch of the coil means.

With all of the embodiments discussed above, an undulating or wave pattern of travel of the yarn through the rotating balloon of yarn is formed so as to create times of contact and times of no contact of predetermined segments of the yarn with the inside surface of the balloon limiter as the yarn segment travels through the balloon limiter to reduce frictional contact between the rotating balloon of yarn and the inside surface of the yarn and to create the above discussed relationships whereby a given yarn segment has an opportunity to cool between times of contact with the inside surface of the balloon limiter and the usual yarn lubricators may be eliminated, as is desired by this invention.

BRIEF DESCRIPTION OF THE DRAWINGS

Some of the objects and advantages of this invention have been stated above, other objects and advantages will appear as the detailed description of this invention continues when taken in conjunction with the accompanying drawings, in which.

DETAILED DESCRIPTION OF PREFERRED EMBODIMENTS OF THE INVENTION

Figure 1:
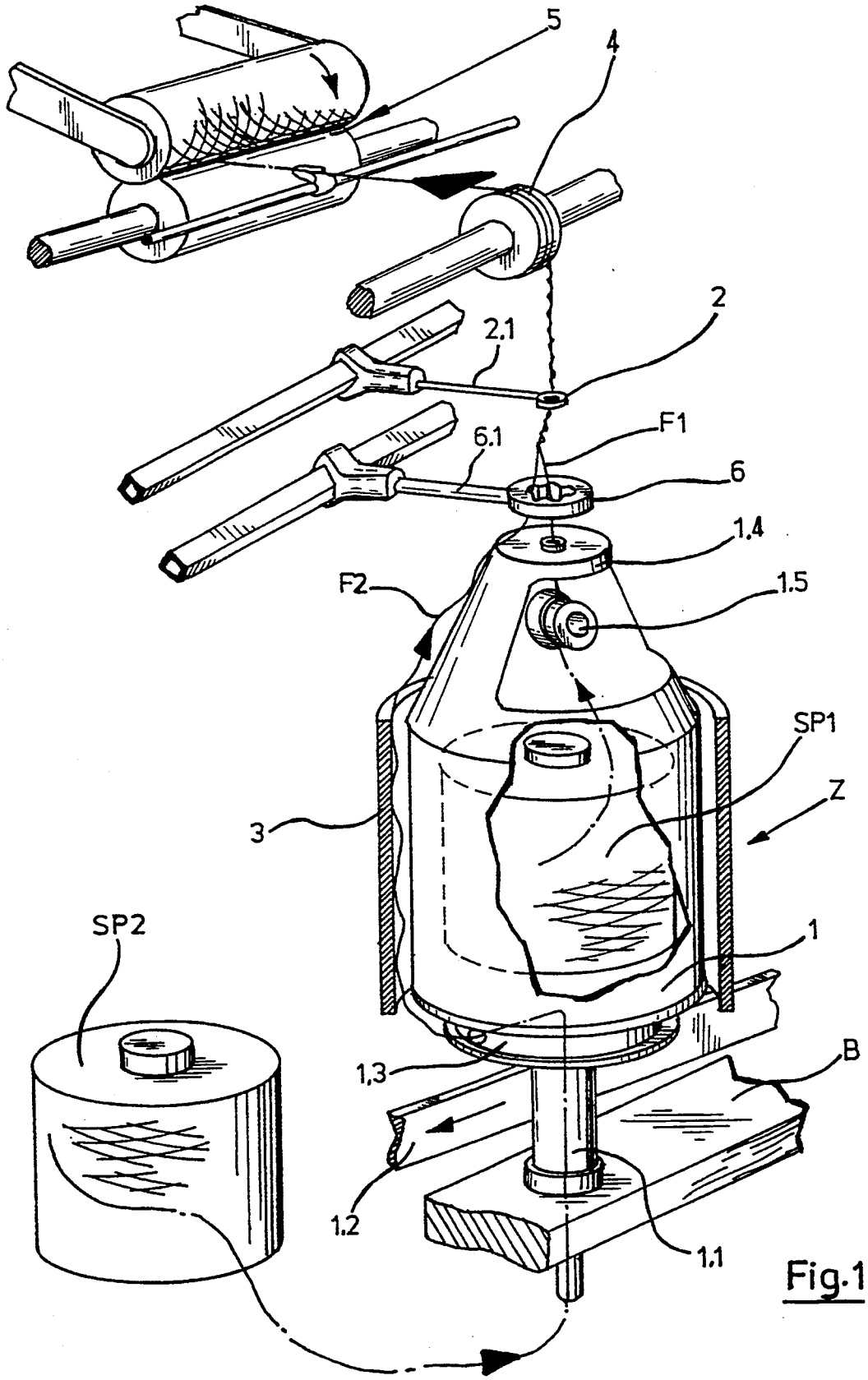
FIG. 1 is a schematic perspective partial view of a spindle assembly within a yarn processing machine and including the improvement of this invention.

Referring now to the drawings, in FIG. 1 there is illustrated, somewhat schematically, a spindle assembly of a textile yarn processing machine. It is well understood to those with ordinary skill in the art, that a textile yarn processing machine, such as a two-for-one twister, cabler or the like, includes a plurality of such spindle assemblies mounted in side-by-side relationship along both sides of the machine. In the drawings of this application, the spindle assemblies, generally indicated at Z, are designed and constructed for cabling operations. However, the invention of this application which will be explained below, is also applicable to two-for-one twisting and other operations in this type of spindle assembly.

The spindle assemblies Z, which are designed and constructed as cabling spindles, comprise a spindle pot 1 which accommodates a first yarn package SP1. A yarn F1 unwinding from yarn package SP1 advances over a yarn brake 1.5 arranged in the top 1.4 of package pot 1. The yarn exits axially from package pot 1 and passes through a balloon yarn guide eyelet 2 which is attached via a holder 2.1 to a machine frame only indicated.

A second yarn package SP2 is arranged outside of package pot 1. The yarn F2 unwinding therefrom advances from the bottom axially through the spindle axis, then deflects in radial direction, and exits radially on a yarn accumulator disk 1.3 which is rotated via a spindle whorl 1.1 by means of a drive belt 1.2. The package pot 1 is surrounded by a cylindrical balloon limiter 3, and yarn F2 advances upward in the space between the outside of package pot 1 and the inside wall of balloon limiter 3, and passes likewise through balloon yarn guide eyelet 2. Due to the rotation of yarn F2 during the operation of the twisting spindle, a yarn balloon forms in known manner between the point of exit of yarn F2 on yarn accumulator disk 1.3 and balloon yarn guide eyelet 2, in which both yarns F1 and F2 combine by looping about one another.

The forming twist advances in known manner, via a deflecting roll 4 to a take-up device 5.

In the known twisting spindles, the yarn F2 contacts in the region of its passage between package pot 1 and balloon limiter 3, the inside surface of the balloon limiter over a substantial portion of the height of balloon limiter 3, whereby the rotating yarn is subjected in this region to substantial friction, which may lead to a considerable heating of the yarn in dependence on the size of the contact surface.

To decrease this friction and to thus enable the processing of unlubricated or only slightly lubricated yarns, an undulating ring 6 is arranged on the upper side of top 1.4 of package pot 1, coaxially to the package axis and below balloon yarn guide eyelet 2. This undulating ring 6 is connected with the machine frame via a holder 6.1 and possesses on its inner side radially inward directed cams 6.2 with interspaces 6.3 which are shaped such that at least an approximately sinusoidal curve of the inner contour of undulating ring 6 forms (see FIG. 2). The diameter of undulating ring 6 is dimensioned such that the yarn F2 rotating in the yarn balloon and passing through undulating ring 6 contacts the latter on its inner side and follows the inner contour of this ring. As a result, the yarn F2 receives periodically a component of movement in radial direction of undulating ring 6. This leads to a periodic disturbance of the yarn balloon in such a manner that transverse waves or an undulating pattern form on the yarn length inside the yarn balloon with outward directed wave crests F1.1 and inward directed wave troughs F1.2.

A "yarn segment" in the meaning of the following description of the invention is a yarn section, whose length is small in comparison with the length of an entire yarn section which exists at a certain point in time and extends from the point of its entry into the yarn balloon to the point of its exit from the yarn balloon, so that it can practically be considered "punctiform". This is, for example, the case with a yarn section, whose length is on the order of its thickness.

This undulating pattern or transverse waves are formed such that the rotating yarn F2 contacts the inside wall of balloon limiter 3 respectively only with partial sections of wave crests F1.1. This can be accomplished with a corresponding configuration of undulating ring 6. As a result of this configuration, "yarn segments" which form yarn F2 as defined above contact the inside wall of balloon limiter 3 only at such time intervals that the following conditions are met:

a) the sum of the times in which each yarn element advancing through the yarn balloon contacts the limiting elements is to the total time of advance of this yarn element through the yarn balloon as 1:5 to 1:200; and b) each contacting time of a yarn element of the traversing yarn is to the subsequent time of no contact as 1:2 to 1:20.

In this manner, it is ensured that each yarn segment is allowed to cool sufficiently during the times in which the inside wall of balloon limiter 3 is not contacted, before the next time of contact starts.

It has shown to be advantageous, that in the undulating ring 6 which encloses the yarn balloon, the radial distance between approximately opposing, inward directed cam tips amounts to 40–150 mm, in particular 70–90 mm, and that the distance between opposing, outward directed cam valleys amounts to 50–160 mm, in particular 80–100 mm. Furthermore, it is advantageous that undulating ring 6 is arranged at a height of about 62% to 88% of the overall balloon height.

Figure 2:
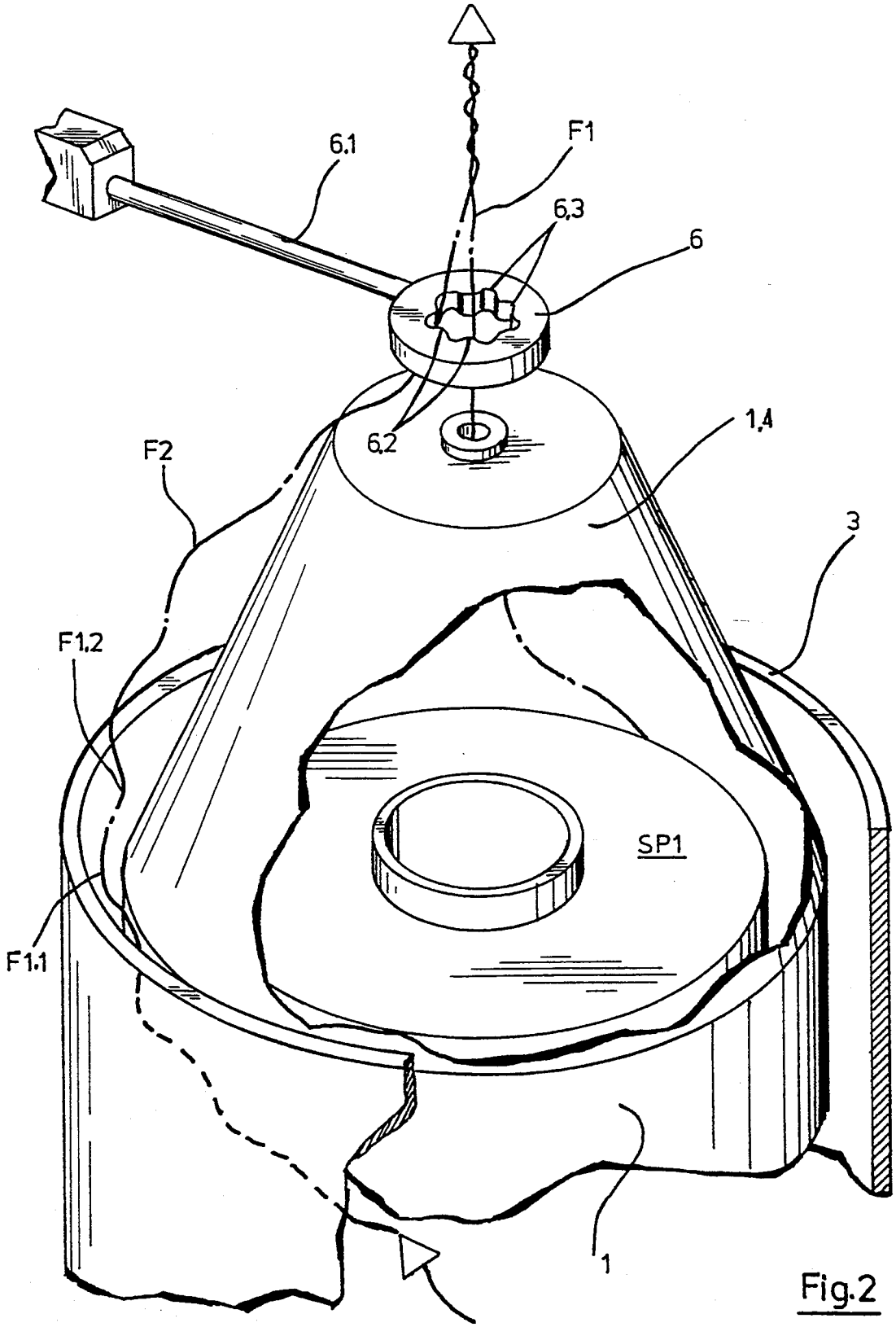
FIG. 2 is an enlarged view of the upper portion of the spindle assembly of FIG. 1.

In the embodiment shown in FIGS. 1 and 2, the undulating ring 6 is provided on its inner side with the contour forming cams.

Figure 3:
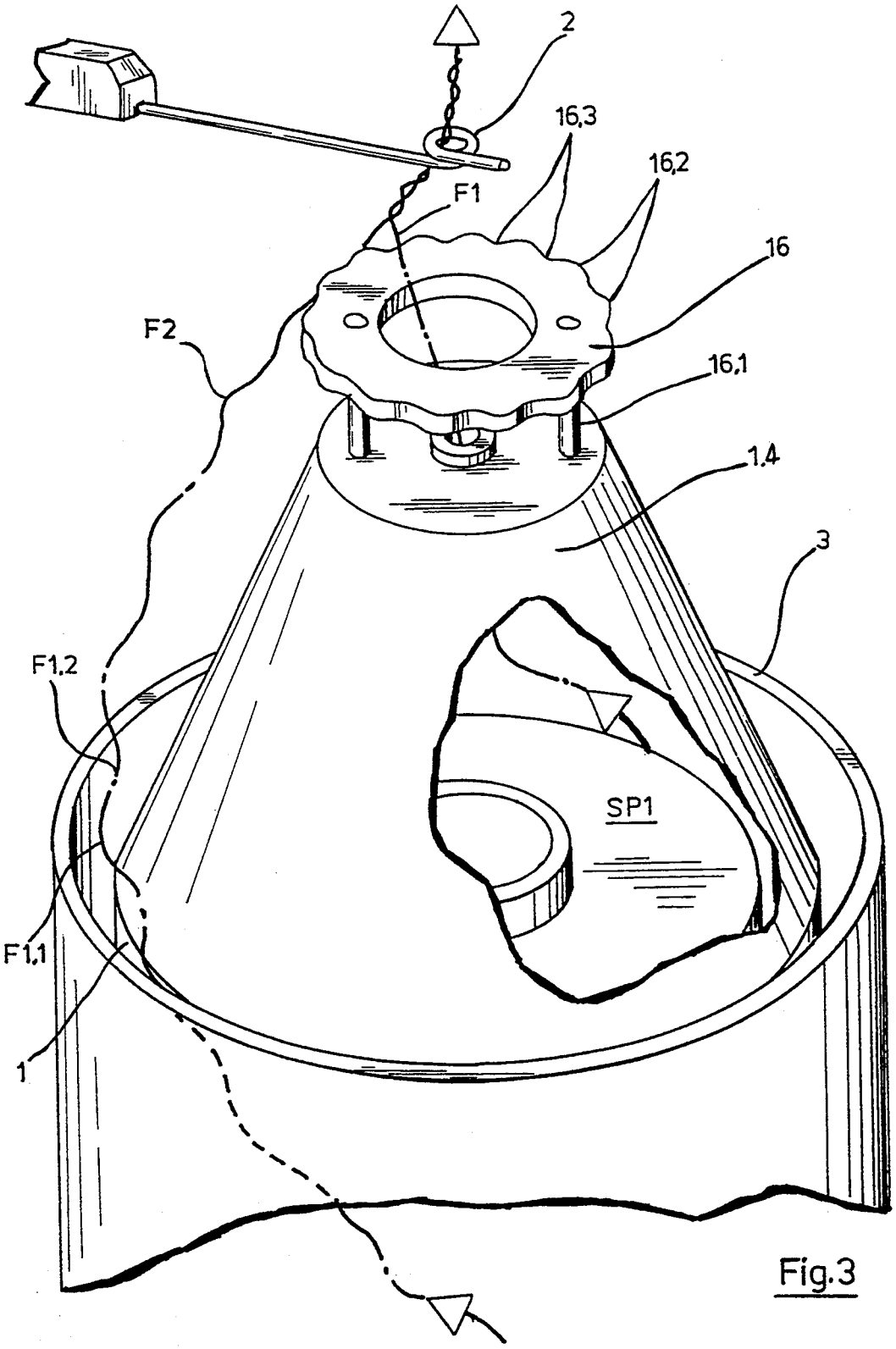
FIG. 3 is a view, like FIG. 2, and illustrating a further embodiment of the improvement of this invention.

Shown in FIG. 3 is a variant of the apparatus, in which an undulating ring 16 is attached via supports 16.1 to the top 1.4 of package pot 1, that is, likewise between top 1.4 of package pot 1 and balloon yarn guide eyelet 2. This undulating ring is provided on its outside with cams 16.2 and interspaces 16.3 which have likewise an at least approximated sinusoidal contour. The yarn F2 forming the yarn balloon advances past undulating ring 16 on the outside thereof such that it contacts the outside of the contour formed by the cams, before it combines with yarn F1 advancing from the interior of the package. In a manner analogous to the embodiment of FIGS. 1 and 2, a transverse wave is produced on yarn F2 with outward directed wave crests F1.1 and inward directed wave troughs F1.2. This leads in the same manner to a contact between the yarn elements and the inside wall of balloon limiter 3, which meets with the above-described conditions and occurs at time intervals.

Figure 4:
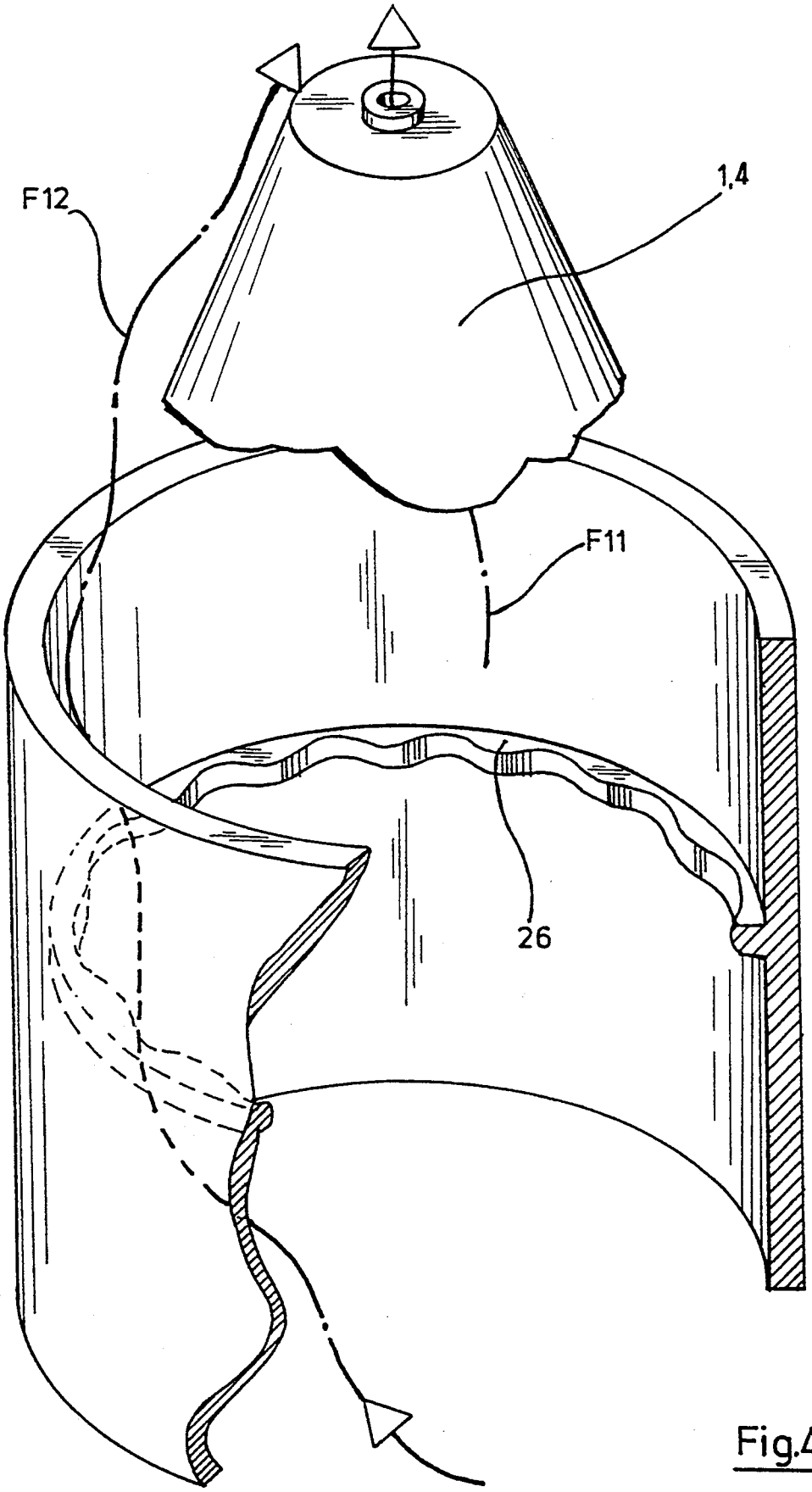
FIG. 4 is a partial perspective view, broken away, of the upper portion of a spindle assembly with some parts removed in order to illustrate a further embodiment of the improvement of this invention.

Shown in FIG. 4 is an embodiment in which an undulating ring 26 is arranged on the inner side of a balloon limiter 13. For reasons of a better illustration, only the top 1.4 of the package pot and a yarn F11 advancing from the interior of the package are indicated. A yarn F12 forming the yarn balloon is surrounded by undulating ring 26 and contacts its contour formed by cams on the inner side of the ring. Also in this arrangement, the aforesaid transverse wave is formed on the yarn, which leads to the contact occurring in time intervals between the yarn elements and the inside wall of balloon limiter 13.

Figure 8:
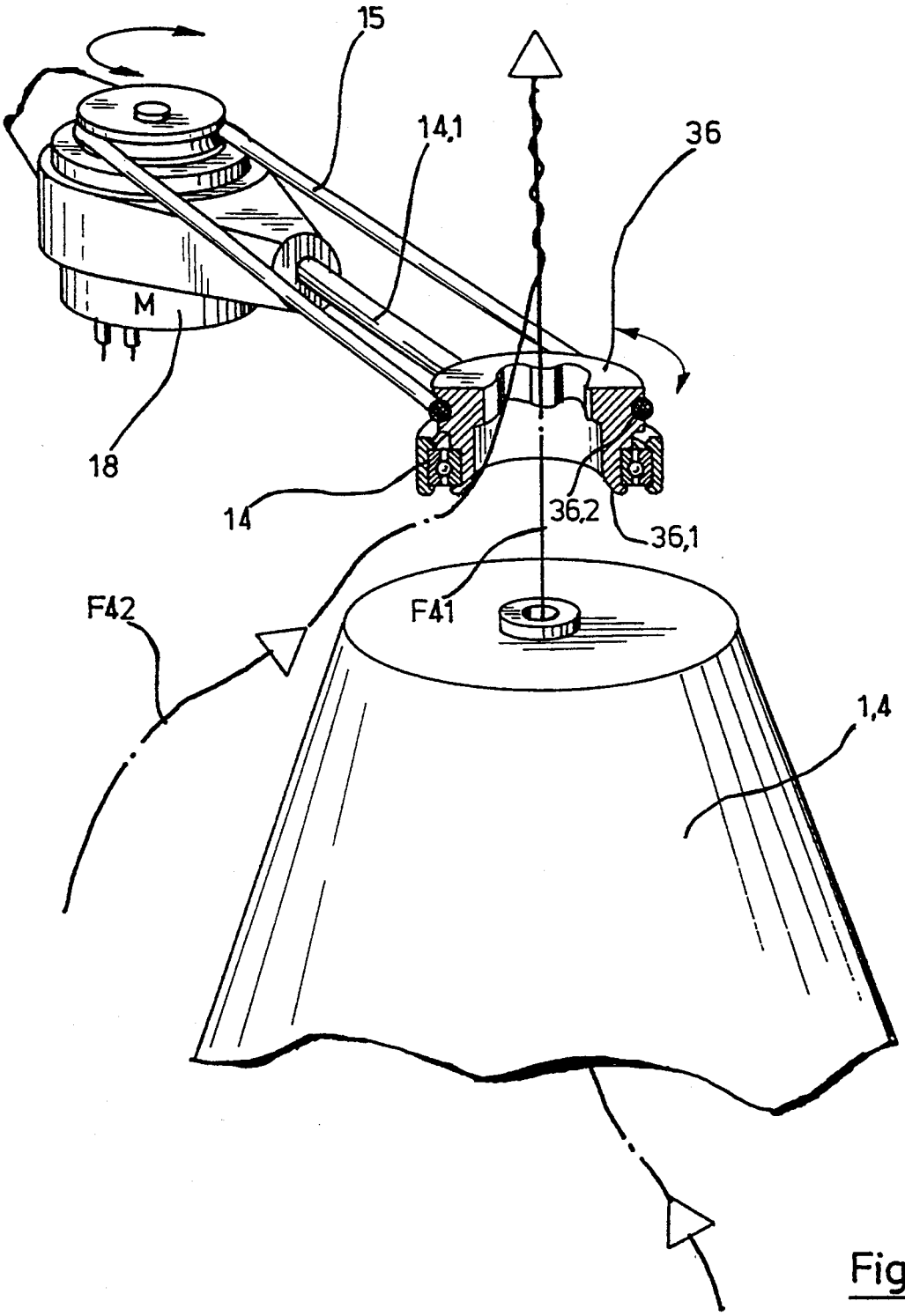
FIG. 8 is a perspective view of the upper portion of a spindle assembly showing still a further embodiment of the improvement of this invention.

Shown in FIG. 8 is a variant of the embodiment of FIG. 2, in which an undulating ring 36 is rotatably supported. To simplify the illustration, only the top 1.4 of the package pot with a yarn F41 advancing from the interior of the package is shown. On its underside, undulating ring 36 is provided with a guide ring 36.1 mounted in a step bearing which is connected with the machine frame via a holder 14.1. On its outside, undulating ring 36 is provided with a peripheral groove 36.2 which engages with a drive belt 15 leading to a drive means 18.

This drive means 18 allows to rotate undulating ring 36 such that its rotational speed is low in comparison with the rotational speed of yarn F42. This has the advantage that the contact zones on the inside wall of the balloon limiter vary in time and space. This may be of importance, in particular when standing waves form on the yarn balloon. Thus, for example, a wear of the balloon limiter concentrated on certain areas is avoided. The rotational speed of undulating ring 36 can, for example, be one thousandth of the rotational speed of yarn F42 in the yarn balloon or less.

The number of cams on the outer or inner side of undulating ring 6 or 16 respectively amounts suitably to 7–19, with a cam amplitude of 2–10 mm.

In a typical embodiment with a spindle pot 1 having a diameter of 300 mm and with a yarn denier of 1,300×1 dtex, for example, at a balloon height of 550 mm, the undulating ring 6 is arranged approximately 100 mm below the balloon tip, and is provided on its inner side with thirteen cams which are shaped such that a cam amplitude of about 5 mm results.

As a result of the cams of the undulating ring, the yarn is set into a high-frequent transverse vibration with wave lengths from 30 mm to 150 mm during the rotation of the balloon. Same leads, as aforesaid, to an extensive inward lifting of the yarn from the inside wall of the balloon limiter. The yarn contact with the balloon limiter is reduced to point contacts with constantly alternating points of contact. The locally produced frictional heat is again dissipated after the shortest time of contact during the times of no contact by air cooling the yarn. A favorable coordination of the wave length of the transverse vibrations and yarn length in the balloon permit standing waves to form between the edge of the yarn accumulator disk and the undulating ring with particularly high amplitudes and particularly little contact between yarn and inside wall of the balloon limiter.

It has further shown that the balloon width, both on the average as in the extremes periodically occurring with the frequency of the transverse wave, is clearly smaller with the use of the undulating ring than in the case of balloon contraction by means of a known, smooth balloon limiting ring with an inside diameter corresponding to the smallest diameter of the undulating ring. Thus, with the use of the undulating ring, two effects superpose, namely, on the one hand the limitation of the contact to point contacts, and on the other hand the decrease of the balloon width, so that the contact between yarn and inside wall of the balloon limiter are clearly reduced both in duration and intensity. As a result, it becomes possible to process on twisting spindles with balloon limiters yarns with little lubrication and without noteworthy frictional damage.

Figure 9:
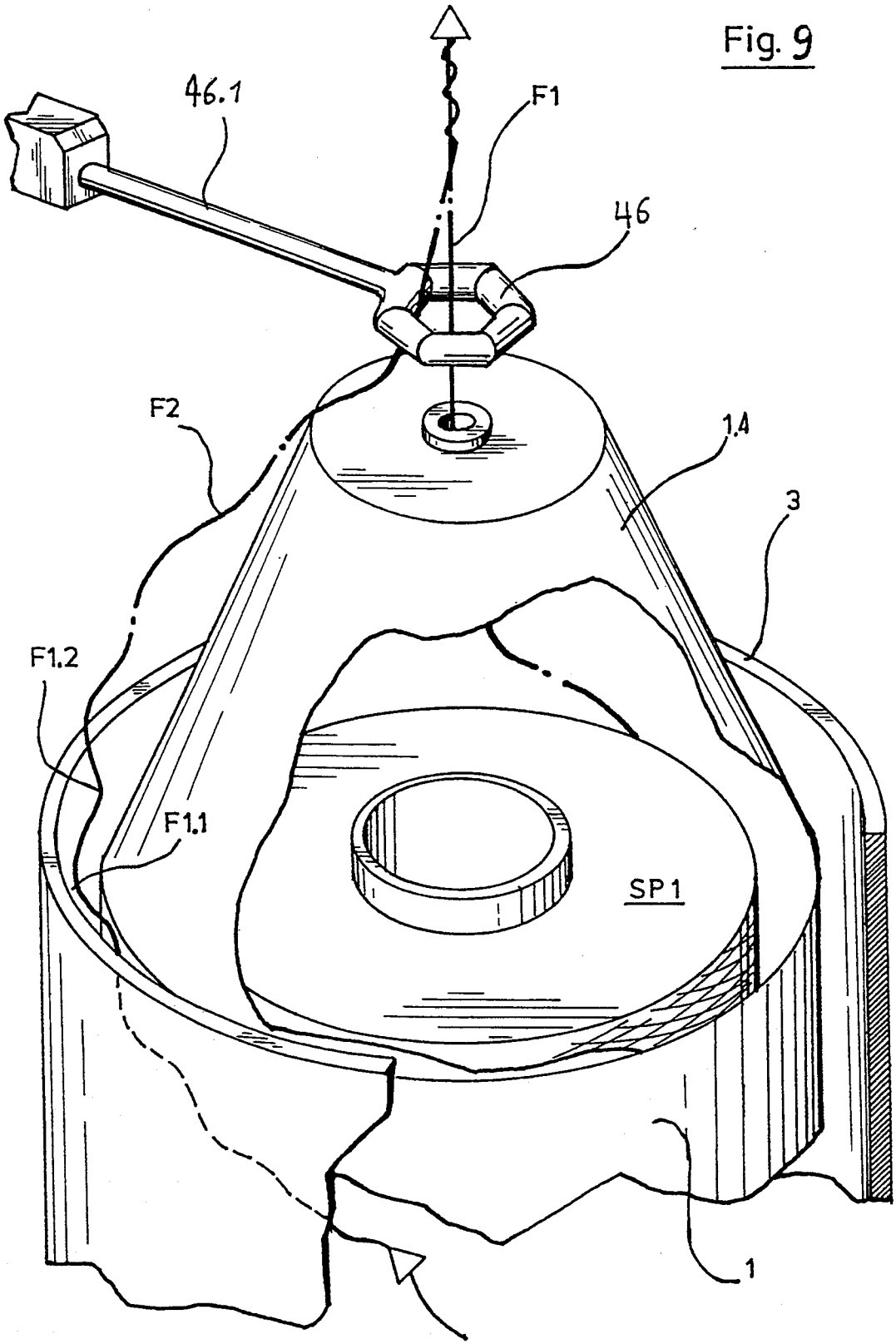
FIG. 9 is a perspective view of the upper portion of a spindle assembly, partially broken away, showing still a further embodiment of the improvement of this invention.

Illustrated in FIG. 9 is an embodiment of a device for generating an undulating pattern or transverse waves on the yarn balloon, in which the undulating ring is configured somewhat different than in the above-described embodiments. As to all its other parts, the apparatus shown in FIG. 9 corresponds to the apparatus of FIGS. 1 and 2. Therefore, all structural parts which correspond exactly to the above-described embodiment, are indicated by the same numerals in FIG. 9. In the following, these structural parts will not be described again. In FIG. 9, an undulating ring 46 is arranged above the top 1.4 of package pot 1, coaxially to the package axis and below the balloon yarn guide tube. The undulating ring 46 is connected via a holder 46.1 with a machine frame not shown in FIG. 9. The undulating ring 46 is shaped as a hexagon bent from a round bar, which means that the inside contour of undulating ring 46 has likewise the shape of a regular hexagon. Naturally, it is also possible to use any other polygon in this place. Also in the case of this undulating ring 46, the yarn F2 following the inside contour of the ring is periodically imparted a component of movement in the radial direction of undulating ring 46. This leads to the previously described disturbance of the yarn balloon, and transverse waves form with outward directed wave crests F1.1 and inward directed wave troughs F1.2.

Figure 10:
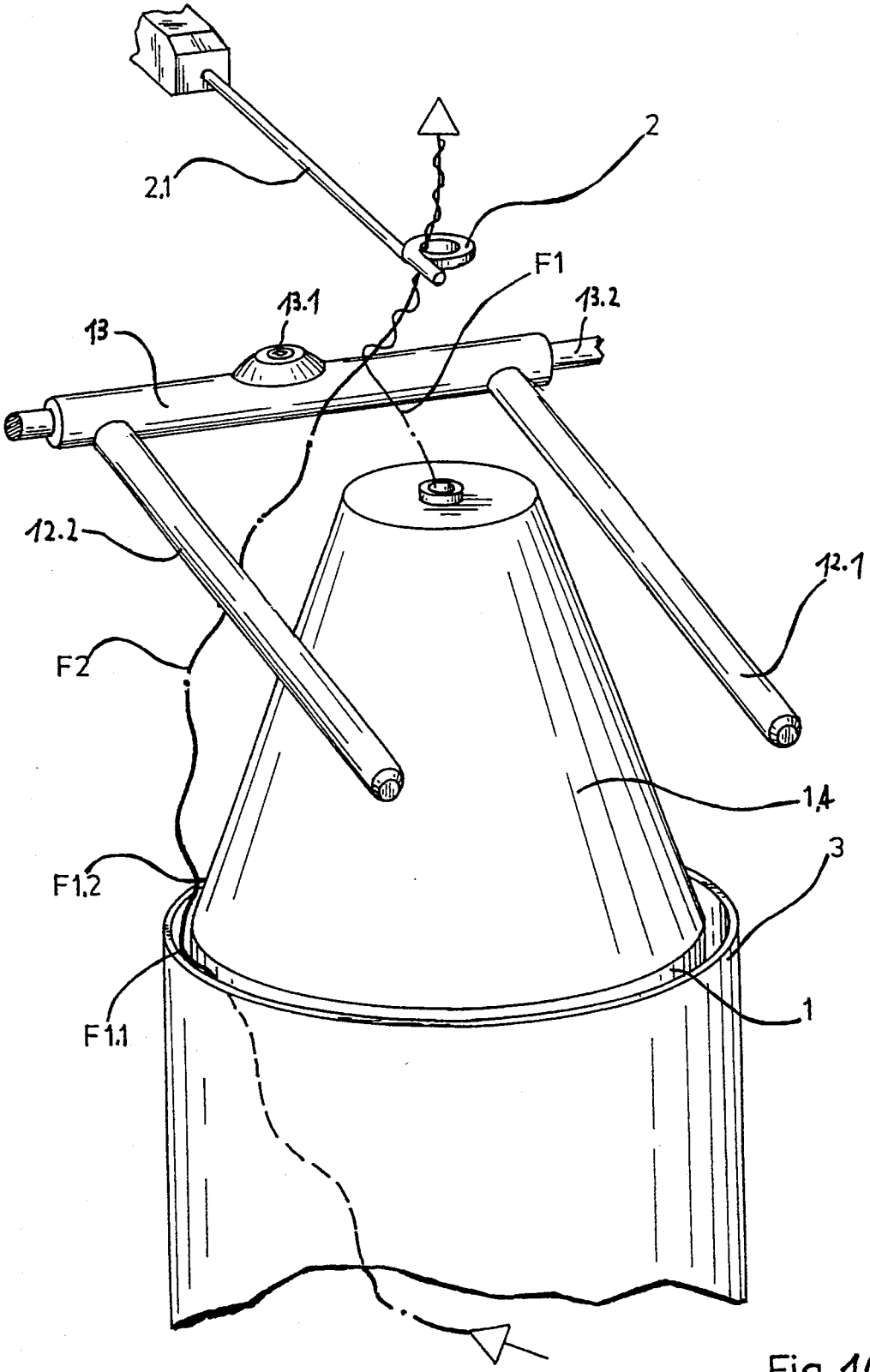
FIG. 10 is a perspective of the upper portion of a spindle assembly showing still a further embodiment of the improvement of this invention.

It should further be pointed out that a generation of transverse waves analogous to the embodiment of FIGS. 1–3 and 9 is also possible with an apparatus in which, as shown in FIG. 10, in the place of an undulating ring, two opposite bars 12.1 and 12.2 extending parallel to one another and obliquely to the spindle axis, are arranged between the upper edge of balloon limiter 3 and yarn guide eyelet 2, on both sides of the range covered by the yarn balloon, in such a manner that they are contacted by the yarn F2 rotating in the yarn balloon on places facing one another. Thus, these bars replace in a way an undulating ring with two opposite cams.

The bars 12.1 and 12.2 are arranged on a tubular holder 13 which is slipped over a rod 13.2 and secured thereto by a screw 13.1. The rod 13.2 is connected with the machine frame not shown in particular. Otherwise, the embodiment of the twisting spindle corresponds to that of FIGS. 1 and 2, and needs therefore not be described again in more detail.

Figure 5:
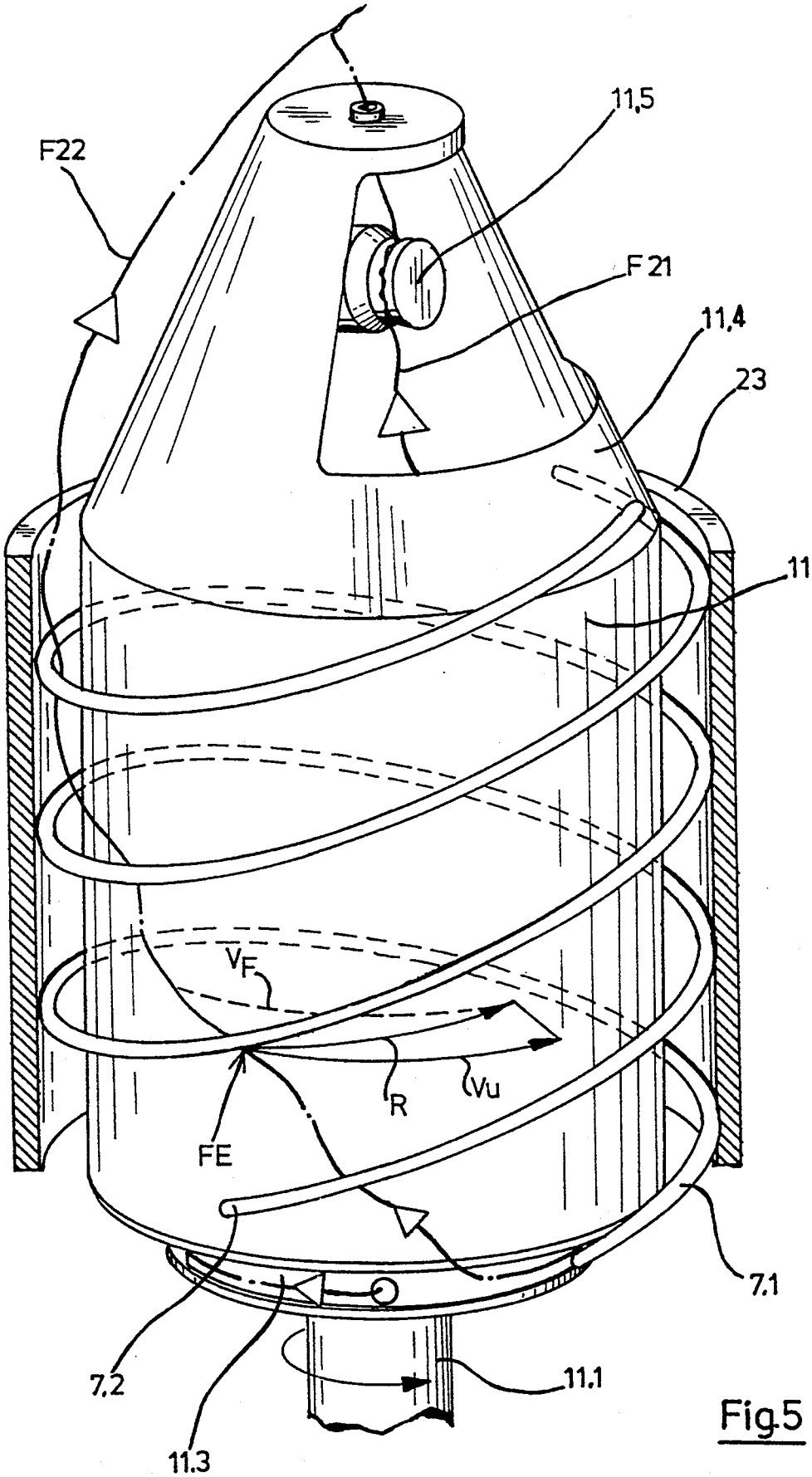
FIG. 5 is a perspective view, partly in section, of a portion of a spindle assembly showing a still further embodiment of the improvement of this invention.

The above-described results could also be obtained with a somewhat differently configured apparatus which will be described below. Shown in FIG. 5 is a twisting spindle comprising a package pot 11, a spindle shaft 11.1, a yarn accumulator disk 11.3, and a package pot top 11.4, in which, as aforesaid, a yarn F21 advancing from a yarn package arranged in the interior of the package pot, via a yarn brake 11.5, is guided axially outward in direction of a yarn guide eyelet not shown, whereas a yarn F22 advancing from an outer yarn package not shown, is guided from the bottom through the spindle shaft, and exits on the yarn accumulator disk 11.3, whence it travels upward in the above-described manner between package pot 11 and balloon limiter 23 to the point of looping with yarn F21. In operation, the yarn F22 forms a yarn balloon. On the inner side of balloon limiter 23, limiting elements are arranged, which are formed as coils of a double thread helix 7.1 and 7.2. In this arrangement, it is made sure that the ratio of coil thickness, that is the wire gauge of the helix, to the axial spacing of adjacent coils, as well as the ratio of the coil pitch of the helix to the slope of each yarn element rotating in the yarn balloon are selected such that the aforesaid conditions a) and b) for the times of contact are met. This is, for example, the case, when the ratio of the coil pitch of the helix to the slope of the yarn element rotating in the balloon is greater than 10:1, and the ratio of coil thickness to the spacing of adjacent coils is smaller than 1:3.

These ratios can be noted from FIG. 5. In FIG. 5, a yarn element FE of yarn F22 is shown, whose movement has on the one hand a component VF in the direction of withdrawal of yarn F22, and on the other hand a component VU in the circumferential direction of the yarn balloon. Due to these two components, a resultant movement R is obtained during the rotation, which has a certain slope relative to the circumferential direction VU extending in a horizontal plane. Likewise, helix 7.1 or 7.1 has a predetermined pitch. As can qualitatively be noted from FIG. 5, the pitch of the helix is clearly greater than the slope R of the yarn element FE. As a result of the above indicated minimum pitch ratio and the ratio of coil thickness to coil spacing, it is ensured that each yarn element FE lies against the inner side of one of the coils of the helix only for a very short time, and enters then into the space between two coils of the helix, in which it moves without contacting the inside wall of balloon limiter 23, until it intersects again the path of a helix coil, and another point contact occurs. During this period of time, the yarn element is cooled. In an example of a double thread helix with a pitch of 15°, a diameter of 330 mm, and a pitch ratio of the coils to the rotating yarn element of 10:1, this means that after yarn element FE has contacted a coil, the next contact will occur approximately after five rotations of the yarn element.

Figure 6:
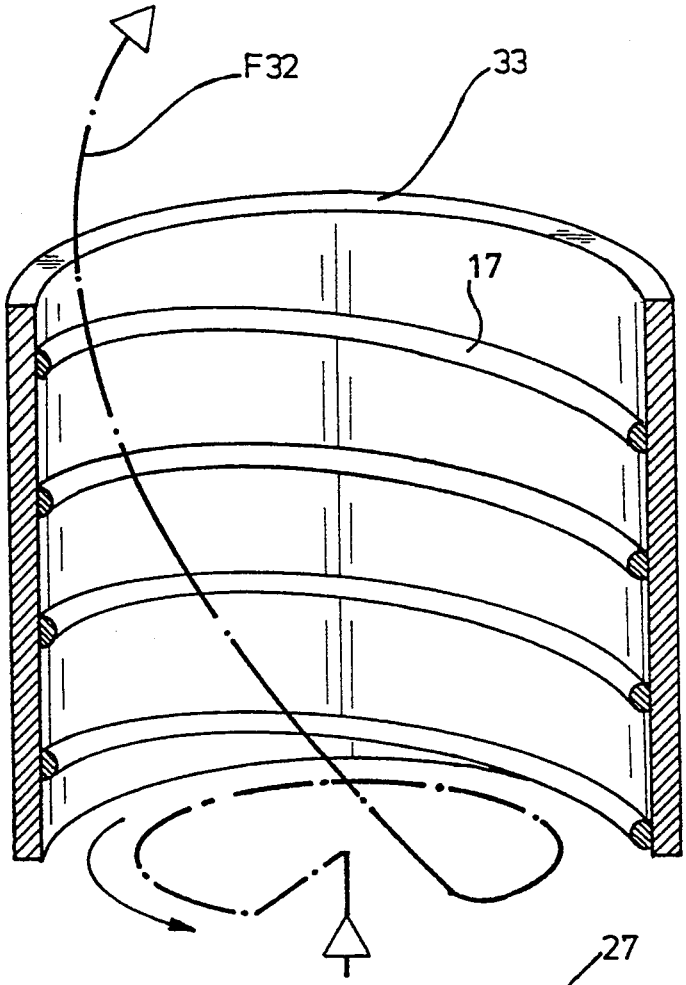
FIGS. 6 and 7 are schematic sectional views showing variations or modifications of the embodiment of the improvement of this invention shown in FIG. 5.

Shown in FIG. 6, is a balloon limiter 33 with a single thread helix 17 arranged on its inside wall. This helix may also be firmly connected with balloon limiter 33, and form, for example, a continuous helical rib, whose pitch and thickness are dimensioned such that the above-described conditions are met, and yarn F32 passing therethrough engages with the rib in point contact.

Figure 7:
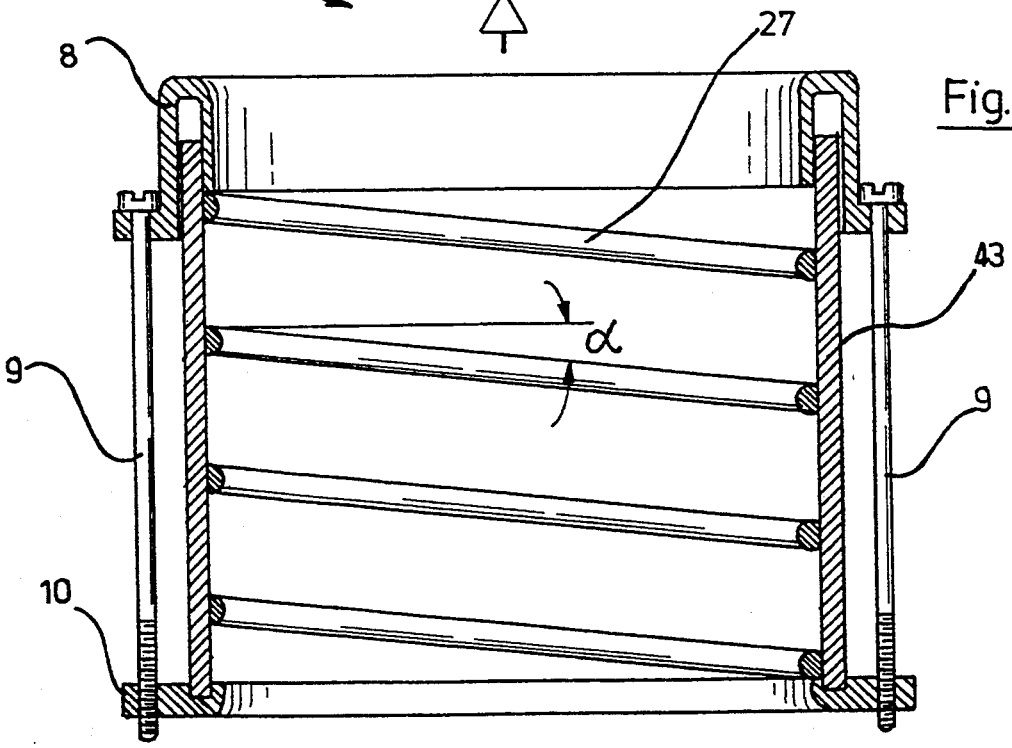

Shown in FIG. 7 is an embodiment, in which a single thread helix 27 is arranged in balloon limiter 43 for sliding movement, there being provided a device which allows to change the pitch $\alpha$ of the helix, so as to achieve an adaptation of the helix to different yarn counts, twist density per unit of length, and spindle speeds, and the different configuration of the yarn balloon connected therewith. To this end, a collar 8 is arranged on the upper edge of balloon limiter 43 for sliding movement in axial direction, which rests with its inside edge against the upper side of helix 27. On the outside, collar 8 is connected via screws 9 with a collar 10 on the lower edge of balloon limiter 43. As can directly be noted from FIG. 7, the vertical position of collar 8 can be adjusted by turning screws 9, and thus it is possible to change the pitch of helix 27.

In the drawings and specification, there have been disclosed preferred embodiments of the invention and although specific terms are employed, they are used in a generic and descriptive sense only and not for purposes of limitation, the scope of the invention is set forth in the following claims.

What is claimed is:

1. A textile yarn processing machine having a plurality of spindle assemblies for processing of yarn, each spindle assembly includes a central axis, means for forming a balloon of yarn which rotates around said spindle assembly central axis as the yarn travels through said spindle assembly during processing, and a balloon limiter device surrounding the rotating balloon of yarn and having a generally cylindrical inside surface for frictional contact with the rotating balloon of yarn to restrict the size of the rotating balloon of yarn; wherein the improvement comprises:

means for (1) forming an undulating pattern of travel for the yarn through the rotating balloon of yarn so as to create times of contact and times of no contact of predetermined segments of the yarn with the inside surface of said balloon limiter as the yarn segment travels through said balloon limiter and (2) creating relationships wherein the sum of the times of contact of a segment of yarn advancing through the yarn balloon with the inside surface of said balloon limiter is to the total time of advance of this yarn segment through the rotating yarn balloon as is 1:5 to 1:200 and wherein each time of contact of the traveling yarn element with the inside surface of the balloon limiter is to each time of no contact as is 1:2 to 1:20, whereby frictional contact between the rotating balloon of yarn and the inside surface of said balloon limiter is reduced to avoid the necessity of the use of lubrication on the yarn being processed, in which said means for forming the undulating path of travel for the yarn and for creating the relationships is positioned along said central axis of said spindle assembly and generally above said balloon limiter device adjacent an upper end of the rotating balloon of yarn for running engagement therewith by the yarn during travel of the yarn through the rotating balloon of yarn and comprises two bars facing each other and extending parallel to each other and obliquely to said spindle assembly central axis and having inside surfaces contacted by the yarn during travel of the yarn through the rotating balloon of yarn.

* * * * *

UNITED STATES PATENT AND TRADEMARK OFFICE

CERTIFICATE OF CORRECTION

PATENT NO. :5,404,703

DATED :April 11, 1995

INVENTOR(S) :Johannes Frentzel-Beyme, et al.

It is certified that error appears in the above-identified patent and that said Letters Patent is hereby corrected as shown below:

On the title page item [30] and item [56]:

Under Foreign Application Priority Data, "42 09 495.3" should be -- 92 09 495.3 --.

Under References Cited, "2,794,491" should be -- 2,994,491 --.

Signed and Sealed this

Fourth Day of July, 1995

Bruce Lehman

*Attest:*

BRUCE LEHMAN

*Attesting Officer*

*Commissioner of Patents and Trademarks*